US011278145B2

(12) United States Patent
Ma

(10) Patent No.: US 11,278,145 B2
(45) Date of Patent: Mar. 22, 2022

(54) CURTAIN WITH ADJUSTABLE LONGITUDINAL SIZE AND MANUFACTURING METHOD THEREOF

(71) Applicant: HANGZHOU CHINA HOME TEXTILES INDUSTRY CO., LTD., Zhejiang (CN)

(72) Inventor: Yingjun Ma, Zhejiang (CN)

(73) Assignee: HANGZHOU CHINA HOME TEXTILES INDUSTRY CO., LTD., Hangzhou (CN)

( * ) Notice: Subject to any disclaimer, the term of this patent is extended or adjusted under 35 U.S.C. 154(b) by 282 days.

(21) Appl. No.: 16/232,070

(22) Filed: Dec. 26, 2018

(65) Prior Publication Data

US 2019/0298098 A1 Oct. 3, 2019

(30) Foreign Application Priority Data

Apr. 3, 2018 (CN) ..... 201810289226.6

(51) Int. Cl.
*A47H 2/00* (2006.01)
*A47H 23/02* (2006.01)

(52) U.S. Cl.
CPC ..... *A47H 2/00* (2013.01); *A47H 23/02* (2013.01)

(58) Field of Classification Search
CPC ..... A47H 21/00; A47H 2201/01; A47H 2201/02; A47H 2201/00; A47H 13/00; A47H 23/00; A47H 23/02; A47H 23/06; A47H 2023/003; A47H 2023/025; A47H 2/00; A47H 23/04
See application file for complete search history.

(56) References Cited

U.S. PATENT DOCUMENTS 7,350,244 B1 * 4/2008 Handley ..... A47K 3/38 4/558
7,909,082 B2 * 3/2011 Peoples ..... A47H 2/00 160/123

(Continued)

FOREIGN PATENT DOCUMENTS

CN 2410952 12/2000
CN 2456595 10/2001

(Continued)

*Primary Examiner* — Daniel P Cahn
*Assistant Examiner* — Matthew R. Shepherd
(74) *Attorney, Agent, or Firm* — Jiwen Chen; Jacobson Holman PLLC

(57) ABSTRACT

This invention relates to a curtain with an adjustable longitudinal size and a manufacturing method thereof. The curtain includes an upper curtain piece and a lower curtain piece, and the upper curtain piece is detachably spliced with the lower curtain piece through a lateral flexible splicing assembly. The lateral flexible splicing assembly includes a first splicing part fixed at the upper curtain piece, and a second splicing part fixed at the lower curtain piece and cooperating with the first splicing part to detachably splice the upper curtain piece and the lower curtain piece. One of the first splicing part and the second splicing part is provided with a plurality of splicing positions, and the other one of the first splicing part and the second splicing part bonds a selected one of the splicing positions so as to splice the curtain with different longitudinal sizes.

1 Claim, 10 Drawing Sheets

(56) References Cited

U.S. PATENT DOCUMENTS

| | | | | |
|---|---|---|---|---|
| 2004/0144505 | A1* | 7/2004 | Johnson | A47H 13/00 160/348 |
| 2012/0222826 | A1* | 9/2012 | Foss | D06M 11/83 160/237 |
| 2016/0302605 | A1* | 10/2016 | Seitz | A47H 23/04 |
| 2017/0027389 | A1* | 2/2017 | Pollard | A47H 13/04 |

FOREIGN PATENT DOCUMENTS

| | | |
|---|---|---|
| CN | 2638596 | 9/2004 |
| CN | 103110331 | 5/2013 |
| CN | 104887034 | 9/2015 |
| CN | 107669080 | 2/2018 |
| CN | 207012050 | 2/2018 |

* cited by examiner

CURTAIN WITH ADJUSTABLE LONGITUDINAL SIZE AND MANUFACTURING METHOD THEREOF

CROSS-REFERENCE TO RELATED APPLICATIONS

This application claims the priority benefit of China Application Serial No. 201810289226.6 filed on Apr. 3, 2018. The entirety of the above-mentioned patent application is hereby incorporated by reference.

BACKGROUND

Field of the Invention

This invention relates to a woven fabric and, more particularly, to a curtain with an adjustable longitudinal size and a manufacturing method thereof.

Description of the Related Art

By arranging a curtain at an inner side of a window, indoor privacy can be protected. Also, sunlight in the summer can be avoided to achieve heat insulation. When the light is relatively dim or temperature is relatively low, the indoor light and/or temperature can be improved by opening the curtain to obtain the sunlight.

However, due to inconsistency of a window height or a floor height, or due to processing tolerance, or a construction thickness of a surface decorative layer on each floor is difficult to consider, etc., the following manufacturing habits are mainly formed.

(1) In the factory, a long fabric is produced and rolled into a roll structure which facilitates storage and transportation. After the actual measurement size is received by a customizing storefront, a curtain cloth with a certain height is processed according to an actual measurement size. Although this method is difficult for mass production in the factory, but this method is still the most important way to obtain the curtain.

(2) By manufacturing a lifting curtain frame disclosed in patent documents such as Chinese Patent Nos. CN207012050U, CN2410952Y, and CN2456595Y, etc. in the factory, and by prefabricating the lifting curtain frame, although the problem of indefinite length of the curtain can be solved, and mass production and application can be achieved, due to a complicated structure and high cost of the curtain frame, and a cover plate structure with a certain height that is required to be processed to cover the curtain frame structure for beauty, the practical application amount is much smaller than that of the curtain made by the above-mentioned method (1).

(3) By providing a rolling-up lifting curtain disclosed in patent documents such as Chinese Patent Nos. CN104887034A and CN2638596Y in the factory, as the solution (2), although the above-mentioned problems are solved and mass production and application can be achieved, the rolling-up lifting curtain is difficult to match a conventional high-grade curtain cloth, such that the application amount of the curtain in real life is much smaller than that of the curtain made by the above-mentioned method (1), especially in formal occasions such as home.

In addition, in order to facilitate the disassembly and cleaning of the curtain cloth and the reinstallation after the cleaning, the curtain structure is designed as structures disclosed in the patent documents such as Chinese Patent Nos. CN103110331A, and CN107669080A, etc., that is, the curtain structure includes an upper curtain piece, a lower curtain piece, and a lateral flexible splicing assembly for detachably splicing the upper curtain piece and the lower curtain piece. The lateral flexible splicing assembly includes a first splicing part fixed at the upper curtain piece and a second splicing part fixed at the lower curtain piece to cooperate with the first splicing part to detachably splicing the upper curtain piece and the lower curtain piece. The lateral flexible splicing assembly usually adopts the structure such as a zipper, a buckle, and a Velcro®. At this time, the zipper, the Velcro®, and the buckle correspond to be the first splicing part and the second splicing part. The curtain designed with this structure can not only facilitate the disassembly and cleaning of the curtain cloth and the reinstallation after the cleaning, but also replace the curtain cloth with different structures, functions or surface patterns according to the changing of the environment and season. For example, in summer, window gauze is replaced to improve ventilation, or a unidirectional sight-transmission curtain cloth is replaced to improve indoor confidentiality. However, the manufacturing method of these curtains continues the three above-mentioned manufacturing habits.

SUMMARY

One object of this invention is to provide a curtain, and the curtain is adjustable in a longitudinal size by modifying a structure of a lateral flexible splicing assembly to enable batch production.

The other object of this invention is to provide a method for manufacturing the above-mentioned curtain.

To achieve the above-mentioned objects, the curtain provided by this invention includes an upper curtain piece and a lower curtain piece, and the upper curtain piece and the lower curtain piece are detachably spliced through a lateral flexible splicing assembly. The lateral flexible splicing assembly includes a first splicing part fixed at the upper curtain piece, and a second splicing part fixed at the lower curtain piece and cooperating with the first splicing part to detachably splice the upper curtain piece and the lower curtain piece. One of the first splicing part and the second splicing part is provided with a plurality of splicing positions, and the other one of the first splicing part and the second splicing part bonds a selected one of the splicing positions so as to splice the curtain with different longitudinal sizes.

A structure of the lateral flexible splicing assembly of the curtain having the upper and lower curtain piece splicing structures is modified, in particular, a plurality of the splicing positions which are at different longitudinal positions are disposed at one of the first splicing part and the second splicing part of the lateral flexible splicing assembly, such that the other splicing part can be fixed at a predetermined splicing position in an alternative manner, so as to realize the adjustment of the curtain in the longitudinal size. Therefore, in the process of manufacturing the curtain, it is not necessary to know a precise height of the curtain for customizing as in the prior art, and the curtain can be mass-produced in the factory.

A specific solution is that the splicing part having a plurality of the splicing positions is a planar splicing structure, multiple-strip-shaped splicing structure, or a multiple-block-shaped splicing structure. The technology of these splicing structures is mature, and these splicing structures are easy to purchase, which effectively reduce the technical difficulty and cost of mass production.

A further solution is that the upper curtain piece is a valance, and the lower curtain piece is a curtain body. For structures of the upper and lower curtain pieces, a two curtain pieces structure or a more than three curtain pieces structure is usually designed according to requirements. While in the two curtain pieces structure, a short upside and long downside structure spliced by the valance and the curtain body is designed, a structure with the same upside and downside in length spliced by the upper curtain piece and the lower curtain piece is designed, or a long upside and short downside structure spliced by the valance and the curtain body is designed. In this technical solution, the short upside and long downside structure spliced by the valance and the curtain body is selected, such that a position of the lateral flexible splicing assembly in the longitudinal direction is closer to the position of the curtain rod, which can effectively reduce an unfolding effect of a lateral resilience of the lateral flexible splicing assembly when the curtain cloth is closed to reduce a covering area of the curtain in a lateral direction, and the curtain can be better closed during usage.

One preferred solution is that one of the splicing parts is the planar splicing structure, the other one of the splicing parts is a band-shaped splicing structure, and a bonding surface of the planar splicing structure is provided with a plurality of laterally arranged bonding alignment strips. One of the splicing parts is arranged in a band shape, and the other one thereof is arranged in a plane shape, which can reduce the lateral resilience of the lateral flexible splicing assembly during the curtain closing process while acquiring a plurality of splicing positions. In addition, by disposing a plurality of laterally arranged bonding alignment strips at the bonding surface of the planar splicing structure, an alignment rate in the process of adjusting the height is improved so as to improve an adjustment speed.

Another preferred solution is that the first splicing part is a planar fastening cloth, and the second splicing part is a fastening band having hooks. A soft fastening cloth is selected as the splicing part to provide a plurality of splicing positions, and the fastening band is selected as the other splicing part, which can not only effectively reduce the lateral resilience of the lateral flexible splicing assembly during the curtain closing process, but also facilitate a fixed connection between the first splicing part and the upper curtain piece.

A more preferred solution is that the bonding surface of the fastening cloth is provided with a plurality of laterally arranged binding alignment strips. By disposing a plurality of laterally arranged bonding alignment strips at the bonding surface of the planar splicing structure, the alignment rate in the process of adjusting the height is improved so as to improve the adjustment speed.

Another more preferred solution is that the alignment strip is attached to the bonding surface to cover the bonding surface of this part, and by covering the partial bonding surface such that the band-shaped splicing structure cannot be bound with the bonding surface of this part, and bonding and splicing operation will be better and more accurately carried out. The alignment strip is an adhesive tape, which facilitates fixing the bonding alignment strip at the bonding surface. The alignment strip is a colored strip structure for easy identification and alignment. The adhesive tape is fixed at the bonding surface of the splicing part by seam sealing; and it is better for mass production and better to fix the bonding alignment strip at predetermined position.

Another preferred solution is that the first splicing part is disposed at a sun-facing side of the upper curtain piece, and a peripheral portion of the first splicing part is fixed at the upper curtain piece by stitching. A hemline structure is fixed at a lower end portion of the upper curtain piece for covering a splicing seam.

Another preferred solution is that one splicing part includes more than one row of a catch, and the other splicing part includes more than one row of a support member for hanging the catch. At least one of the row of the catch and the row of the support member is plural. The catch and the support member are detachably spliced, and the catch and the support member can be arranged in a discrete fixed structure, which effectively reduces the lateral resilience of the lateral flexible splicing assembly during the curtain closing process.

A more preferred solution is that the catch is a necked-type elastic catch which effectively improves the connection stability between the catch and the support member. The support member is a flexible thread with two ends fixed at the curtain cloth or a cutting mouth fixed at a base cloth. The structure of the support member is simple which is easy to manufacture, and the support member can effectively reduce the lateral resilience of the lateral flexible splicing assembly. A row number of the support member is plural, and a row number of the catch is one, which can effectively reduce the lateral resilience of the lateral flexible splicing assembly and reduce the cost. The catch is fixed at an upper end portion of the lower curtain piece.

Another preferred solution is that the bonding surface of the splicing part on the upper curtain piece is a sun-facing surface, so as to facilitate the hiding of the splicing assembly in a front view of the curtain.

Another preferred solution is that the first splicing part is fixed at the lower end portion of the upper curtain piece, or at the lower end portion and a middle portion of the upper curtain piece, that is, the first splicing part is at least fixed at the lower end portion of the upper curtain piece, and the second splicing part is fixed at the upper end portion of the lower curtain piece.

Another preferred solution is that the curtain is that one to four groups of the upper and lower curtain pieces structure are spliced by one to four lateral flexible splicing assemblies with two to five curtain pieces.

Another preferred solution is that the curtain is one group of the upper and lower curtain pieces structure spliced by one lateral flexible splicing assembly and two curtain pieces or two groups of the upper and lower curtain pieces structure spliced by two lateral flexible splicing assemblies and three curtain pieces.

To achieve the other above-mentioned object, the manufacturing method of the curtain provided by this invention includes a material preparation step and a fixing step. The material preparation step includes preparing the upper curtain piece, the lower curtain piece, the fastening cloth, and the fastening band having hooks according to a predetermined size. The fixing step includes fixing the fastening cloth at a surface of one of the curtain pieces, and fixing the fastening band at a surface of the other one of the curtain piece. A plurality of laterally arranged binding alignment strips are fixed at a binding surface of the fastening cloth in advance, or the laterally arranged binding alignment strips are fixed at the predetermined positions on the binding surface of the fastening cloth after the fixing step.

The curtain produced by the above-mentioned manufacturing method can be mass produced better than the prior art because of the adjustable size in a longitudinal direction.

A specific solution is that the fastening cloth is fixed at the sun-facing side of the upper curtain piece. A step of fixing a plurality of the laterally arranged binding alignment strips includes pressing a plurality of laterally arranged adhesive tapes at the predetermined positions on the binding surface by press gluing.

DESCRIPTION OF THE EMBODIMENTS

This invention will be further described below in combination with embodiments and accompanying drawings.

Curtain of a First Embodiment

Figure 1:
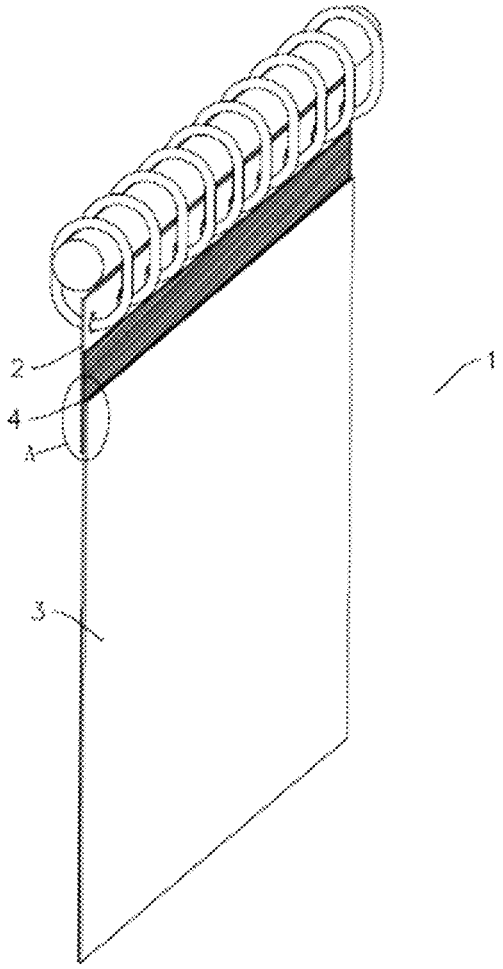
FIG. 1 is a perspective view of a curtain of a first embodiment and a curtain rod of this invention.
Figure 2:
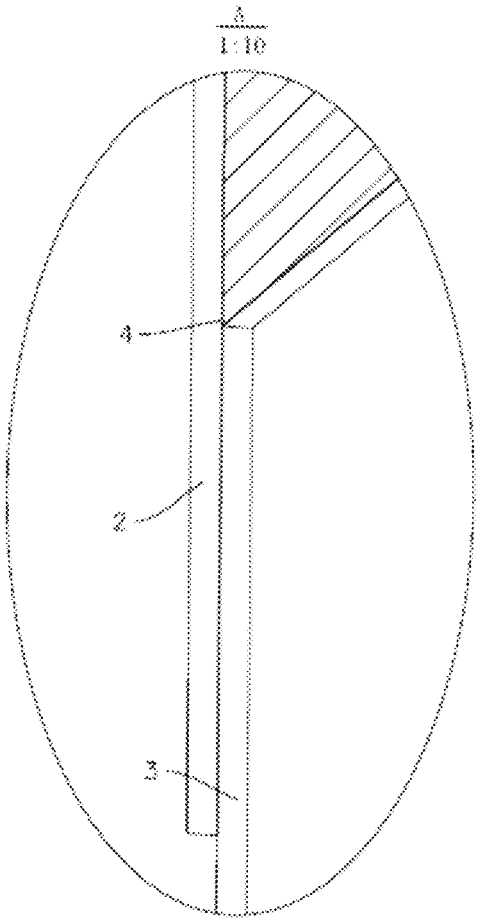
FIG. 2 is a partial enlarged view of (A) in FIG. 1.
Figure 3:
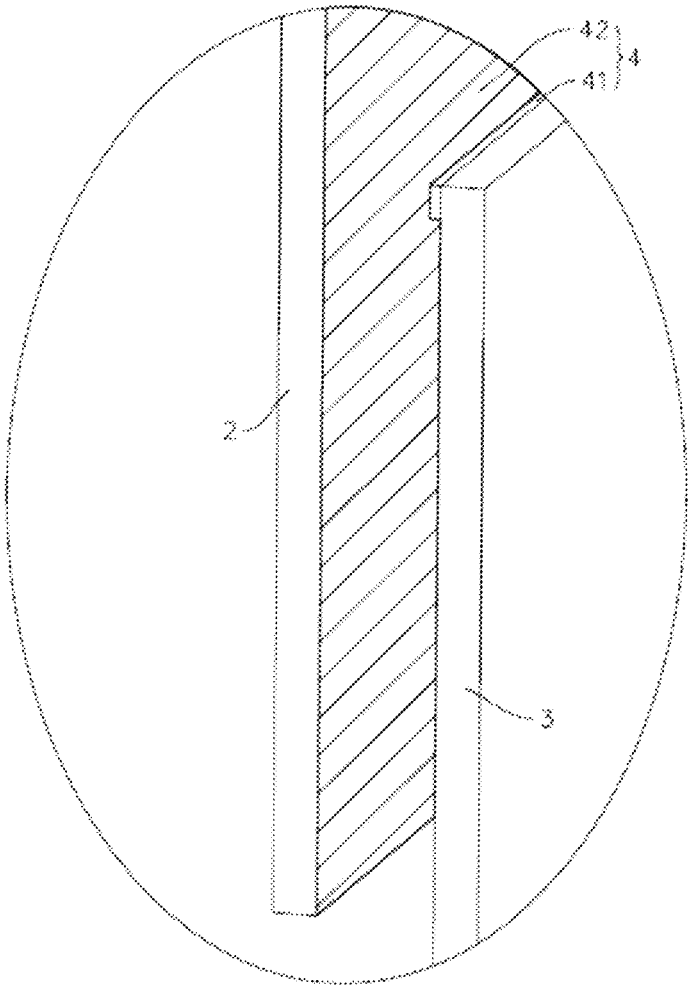
FIG. 3 is a structural schematic view of a lateral flexible splicing assembly of the curtain of the first embodiment of this invention.

See FIG. 1 to FIG. 3, this curtain includes an upper curtain piece 2, a lower curtain piece 3, and a lateral flexible splicing assembly 4 used to detachably splice the upper curtain piece 2 and the lower curtain piece 3. In this embodiment, the upper curtain piece 2 is a valance, and the lower curtain piece 3 is a curtain body, that is, this curtain of this embodiment of the invention is a splicing structure having a short upside and a long downside spliced by the valance and the curtain body.

As show in FIG. 2 and FIG. 3, the lateral flexible splicing assembly 4 includes a fastening band 41 and a planar fastening cloth 42 as shown in a shaded portion of the figures. The fastening band 41 is fixed at a backlight surface of the lower curtain piece 3 by stitching; and the fastening cloth 42 is fixed at a sun-facing surface of the upper curtain piece 2 by stitching, and at least a peripheral portion of the fastening cloth 42 is stitched at the upper curtain piece 2, such that the lateral flexible splicing assembly 4 can be well concealed when viewed from a front of the curtain 1, and whole of the lateral flexible splicing assembly 4 is placed at a valance position, effectively ensuring the overall aesthetics of the curtain. The fastening cloth 42 is the first splicing part of this embodiment, and the fastening band 41 is the second splicing part of this embodiment.

As the fastening cloth 42 is covered with soft fiber loops on a binding surface of the fastening cloth 42, and the fastening band 41 is covered with hooks, such that the fastening cloth 42 and the fastening band 42 can be detachably bound.

In this embodiment, the fastening cloth 42 is fixed at a lower end portion and a middle portion of the valance, and a lower edge of the fastening cloth 42 is aligned with a lower end edge of the fastening. The fastening band 41 is fixed at an upper end portion of the curtain body, and an upper edge of the fastening band 41 is aligned with an upper end edge of the curtain body.

Since a longitudinal size of the fastening cloth 42 is larger than that of the fastening band 41 and bindable positions are continuously arranged to present a planar structure, specifically, the longitudinal size of the fastening cloth 42 is twice or even ten times more than that of the fastening band 41, that is, in this embodiment, the first splicing part is a planar splicing structure.

During the usage, the fastening band 41 separated from the fastening cloth 42 is adjusted in a longitudinal direction and then bound to a corresponding position of the fastening cloth 42 to adjust a spacing between the upper end edge and the lower end edge of the curtain 1, that is, the longitudinal size of the curtain 1 is adjusted to match height requirements of the actual installation scene.

In this embodiment, as the fastening cloth 42 is a continuously arranged planar splicing structure in a bindable area and in the longitudinal direction, such that there are theoretically numerous splicing positions, and the positional difference of these splicing positions in the longitudinal direction may be any value.

In this embodiment, not only the adjustment of the longitudinal size of the curtain 1 can be achieved, but also the disassembly and assembly of the curtain body 3 during the cleaning process can be facilitated, and the curtain body 3 with different structures or patterns can be replaced according to the application scene and season.

Curtain of a Second Embodiment

Figure 4:
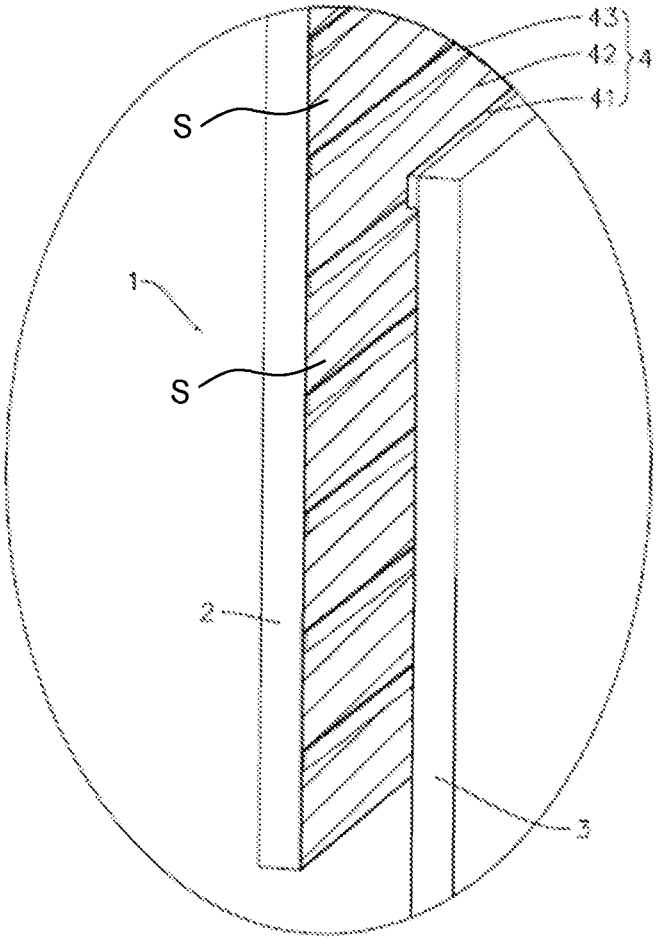
FIG. 4 is a structural schematic view of a lateral flexible splicing assembly in a curtain of a second embodiment of this invention.
Figure 5:
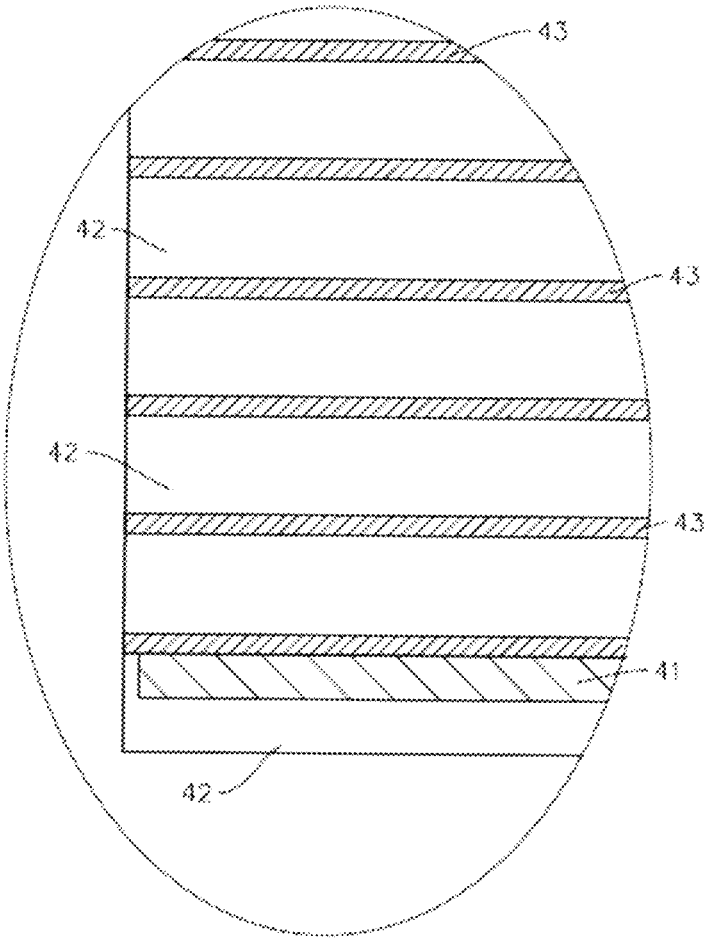
FIG. 5 is a schematic view of a splicing process in the curtain of the second embodiment of this invention.

See FIG. 4 to FIG. 5, this curtain includes an upper curtain piece 2, a lower curtain piece 3, and a lateral flexible splicing assembly 4 used to detachably splice the upper curtain piece 2 and the lower curtain piece 3. In this embodiment, the upper curtain piece 2 is a valance, and the lower curtain piece 3 is a curtain body, that is, this curtain embodiment of the invention is a splicing structure having a short upside and a long downside spliced by the valance and the curtain body.

The lateral flexible splicing assembly 4 includes a fastening band 41, a planar fastening cloth 42 as shown in a shaded portion of the figure, and laterally arranged adhesive tapes 43. During the binding process of the fastening band 41 and the fastening cloth 42, the binding position is aligned by the adhesive tape, that is, the adhesive tape 43 is the binding alignment strip in this embodiment. The fastening band 41 is fixed at a backlight surface of the lower curtain piece 3 by stitching. The fastening cloth 42 is fixed at a sun-facing surface of the upper curtain piece 2 by stitching, such that the lateral flexible splicing assembly 4 can be well concealed when viewed from the front of the curtain 1, and whole of the lateral flexible splicing assembly 4 is placed at the valance position, effectively ensuring the overall aesthetics of the curtain. The adhesive tape 43 is pressed onto the binding surface of the fastening cloth 42 by press gluing, that is, the adhesive tape 43 is attached to a part of the bonding surface S of the fastening cloth 42 to cover this part of the bonding surface S, such that the fastening band 41 is not bound to this part of the bonding surface S. The fastening cloth 42 and a plurality of adhesive tapes 43 fixed at the fastening cloth 42 form the first splicing part of this embodiment, and the fastening band 41 forms the second splicing part of this embodiment.

As the fastening cloth 42 is covered with soft fiber loops on the bonding surface S of the fastening cloth 42, and the fastening band 41 is covered with hooks, such that the fastening cloth 42 and the fastening band 41 can be detachably bound.

In this embodiment, the fastening cloth 42 is fixed at a lower end portion and a middle portion of the valance, and a lower edge of the fastening cloth 42 is aligned with a lower end edge of the valance. The fastening band 41 is fixed at an upper end portion of the curtain body, and an upper edge of the fastening band 41 is aligned with an upper end edge of the curtain body.

In this embodiment, the adhesive tapes 43 divide the bonding surface S of the planar fastening cloth 42 into a plurality of strip-shaped fastening cloth areas arranged in a lateral direction, that is, into a plurality of discontinuous bonding surface areas, and the longitudinal size of those bonding surface areas are larger than the that of the fastening band 41. That is, in this embodiment, the first splicing part is a plurality of strip-shaped splicing structures, and a number of the strip-shaped splicing structures is set according to the actual application scene, which is more than five in this embodiment.

During usage, the fastening band 41 separated from the fastening cloth 42 is adjusted in the longitudinal direction and then bound to a corresponding bonding surface area to adjust the spacing between the upper end edge and the lower end edge of the curtain 1, that is, the longitudinal size of the curtain 1 is adjusted to match the height requirements of the actual installation scene. And during the splicing process of the longitudinal size adjustment, the fastening band 41 is aligned in the bonding process by correspondingly aligning the upper edge or the lower edge of the fastening band 41 with the lower edge or the upper edge of the adhesive tape 43, which not only effectively improves the alignment rate, but also prevent the first splicing part and the second splicing part from being obliquely spliced based on the fact that fastening band 41 and the adhesive tape 43 cannot be bound. That is, in this embodiment, each adhesive tape 43 can provide alignment for two splice positions, meaning that in this embodiment, a number of provided splicing positions is at least twice that of the adhesive tapes. Of course, the adhesive tape 43 attached to the upper and lower edges of the fastening cloth 42 can only provide alignment for one of the splicing positions. For part of the areas that the longitudinal size of the bonding surface area is larger than that of the fastening band 41, that is, part of the areas that a distance between two adhesive tapes 43 is larger than the fastening band 41, these areas can also provide a partially continuously adjustable splicing positions, and for these splicing positions, the adhesive tape can be used for reference alignment.

Curtain of a Fourth Embodiment

As a description of this curtain of a fourth Embodiment, only difference from the above-mentioned embodiments will be described below.

Figure 6:
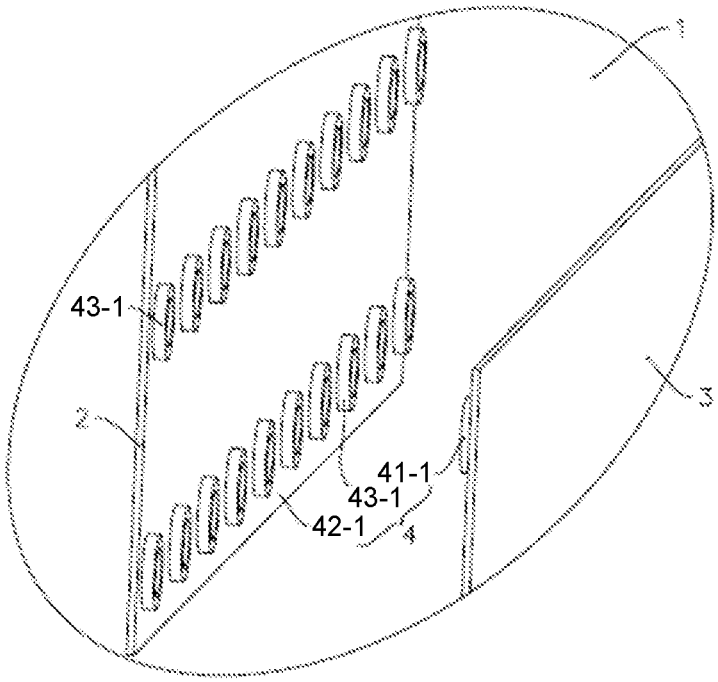
FIG. 6 is a structural schematic view of a lateral flexible splicing assembly in a curtain of a fourth embodiment of this invention.

See FIG. 6, a multi-row buckle 43-1 is fixed at the base cloth 42-1, and an one-row buckle 41-1 is fixed at the upper end portion of the lower curtain piece 3. That is, in this embodiment, the base cloth 42-1 and the multi-row buckle 43-1 fixed at the base cloth 42-1 together form the first splicing part of this embodiment, the one-row buckle 41-1 form the second splicing part of this embodiment, and the base cloth 42-1 and the multi-row buckle 43-1 together form a multiple-block-shaped splicing structure.

By selecting the one-row buckle 41-1 and one row of the multi-row buckle 43-1 to perform detachable buckling, the detachable splicing between the upper curtain piece 2 and the lower curtain piece 3 is achieved, such that the longitudinal size of the curtain 1 is adjusted. The buckle 41-1 and the buckle 43-1 can adopt a magnetic buckle or a male and female buckle.

In this embodiment, the buckle 43-1 is arranged in different rows on the base cloth 42-1 to form splicing positions having equal number of rows of the buckle 43-1.

Curtain of a Fifth Embodiment

As a description of this curtain of a fifth embodiment, only difference from the above-mentioned embodiments will be described below.

Figure 7:
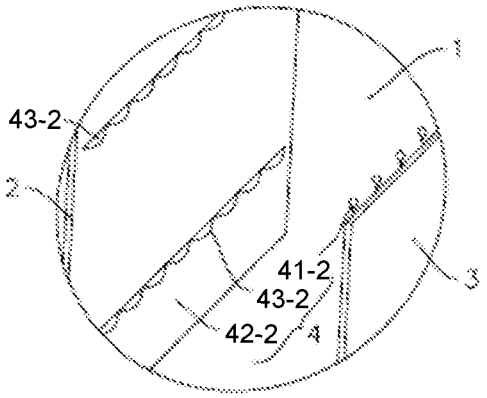
FIG. 7 is a structural schematic view of a lateral flexible splicing assembly in a curtain of a fifth embodiment of this invention.

See FIG. 7, multi-row lateral cutting openings 43-2 are laterally cut at the base cloth 42-2, and one row of a catch 41-2 is fixed at the upper end portion of the lower curtain piece 3. That is, in this embodiment, the base cloth 42-2 and the multi-row lateral cutting openings 43-2 fixed at the base cloth 42-2 together form the first splicing part of this embodiment, the one row of the catch 41-2 form the second splicing part of this embodiment, and the base cloth 42-2 and the multi-row lateral cutting openings 43-2 together form a plurality of block-shaped splicing structures. In order to improve the fastening of the lateral catch 41-2 on a corresponding of the lateral cutting opening 43-2, the catch 41-2 is a necked-type elastic catch, and a closed-type elastic catch is further selected. The lateral cutting openings 43-2 are used as support members for hanging the catches 41-2 in this embodiment. A cutting size and a cutting shape of the lateral cutting opening 43-2 are selected according to the size and shape of the catch. The figure is only a schematic view and does not represent the shape and size of the cutting opening.

By selecting the catch 41-2 and one row of the multi-row lateral cutting openings 43-2 to perform detachable buckling, the detachable splicing between the upper curtain piece 2 and the lower curtain piece 3 is achieved, such that the longitudinal size of the curtain 1 is adjusted.

In this embodiment, the lateral cutting openings 43-2 are arranged in different rows on the base cloth 42-2 to form splicing positions having equal number of rows of the lateral cutting openings 43.

Curtain of a Seventh Embodiment

As a description of this curtain of a seventh embodiment, only difference from the above-mentioned embodiments will be described below.

Figure 8:
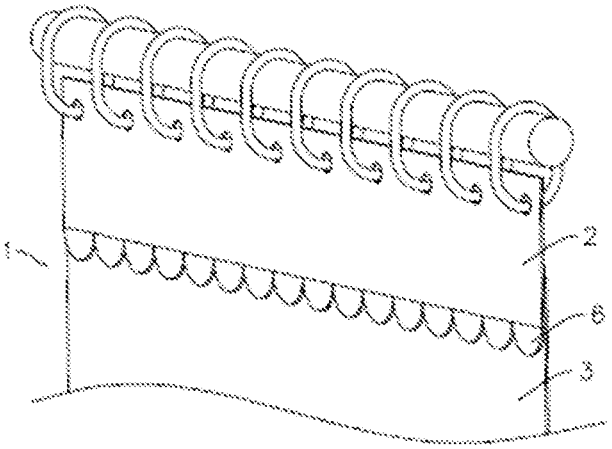
FIG. 8 is a perspective view of a curtain of a seventh embodiment and a curtain rod of this invention.

See FIG. 8, a hemline structure 6 for covering a splicing seam between the upper curtain piece 2 and the lower curtain piece 3 is fixed at the lower end portion of the upper curtain piece 2 to improve the overall coordination and aesthetics of whole of the curtain 1.

Curtain of an Eighth Embodiment

As a description of this curtain of an eighth embodiment Eight, only difference from the above-mentioned first embodiment to seventh embodiment Seven will be described below.

Figure 9:
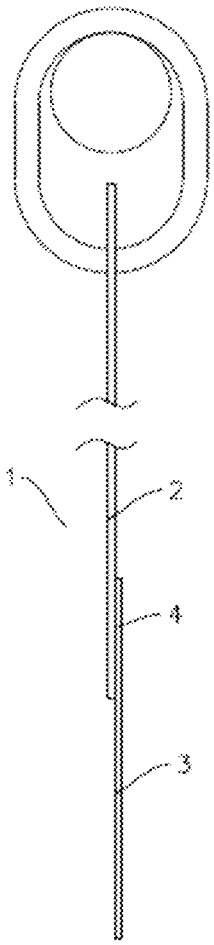
FIG. 9 is a schematic view of a side direction structure of a curtain of an eighth embodiment and a curtain rod of this invention.

See FIG. 9, the upper curtain piece 2 is the curtain body, and the lower curtain piece 3 is a curtain tail, that is, this curtain 1 of the invention is a splicing structure having a long upside and a short downside spliced by the curtain body and the curtain tail through the lateral flexible splicing assembly 4.

Curtain of a Ninth Embodiment

As a description of this curtain of a ninth Embodiment, only difference from the above-mentioned first embodiment to seventh embodiment will be described below.

Figure 10:
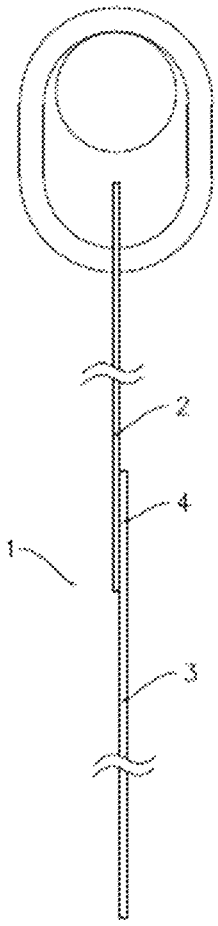
FIG. 10 is a schematic view of a side direction structure of a curtain of a ninth embodiment and a curtain rod of this invention.

See FIG. 10, the upper curtain piece 2 and the lower curtain piece 3 are both semi curtain pieces, that is, the longitudinal size of the two are substantially equal. That is, this curtain 1 of the invention is a splicing structure having the same length in the upside and the downside spliced by the upper semi curtain piece and the lower semi curtain piece through the lateral flexible splicing assembly 4.

Curtain of a Tenth Embodiment

As a description of this curtain of the tenth embodiment, only difference from the above-mentioned first embodiment to ninth embodiment will be described below.

Figure 11:
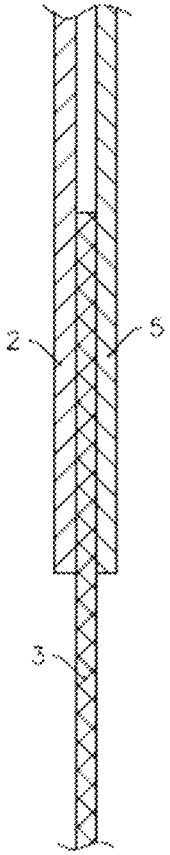
FIG. 11 is a schematic view of a side direction structure of a curtain of a tenth embodiment of this invention.

See FIG. 11, the first splicing part 5 is located at a sun-facing side of the upper curtain piece 2, and a backlight surface of the first splicing part 5 is the bonding surface, that is, the lower curtain piece 3 is located at a backlight side of the first splicing part and between the upper curtain piece 2 and the first splicing part 5, such that the first splicing part 5 can be used to cover the splicing surface of the upper curtain piece and the lower curtain piece at the sun-facing side.

The upper end edge of the first splicing part 5 is fixed at the upper curtain piece 2 by stitching, and edges at two sides are detachably connected by a buckle, a zipper or a Velcro®.

Curtain of an Eleventh Embodiment

As a description of this curtain of an eleventh embodiment, only difference from the above-mentioned first embodiment to seventh embodiment will be described below.

Figure 12:
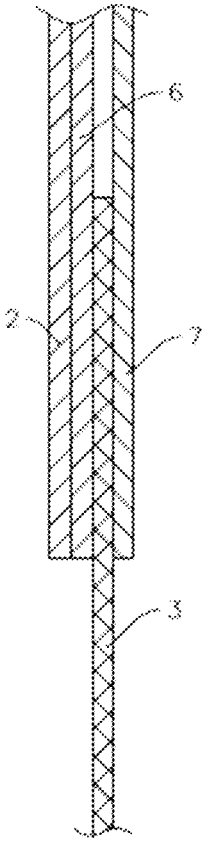
FIG. 12 is a schematic view of a side direction structure of a curtain of an eleventh embodiment of this invention.
Figure 13:
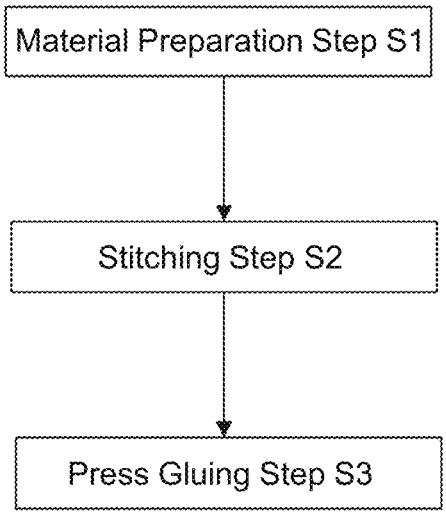
FIG. 13 is a workflow chart of a manufacturing method for the curtain of the first embodiment of this invention.

See FIG. 12, the first splicing part 6 is located at a sun-facing side of the upper curtain piece 2, and a sun-facing surface of the first splicing part 6 is the bonding surface. A cover cloth 7 located at a sun-facing side of the lower curtain piece 3 is fixed at the upper curtain piece 2, that is, the lower curtain piece 3 is located at the sun-facing side of the first splicing part 6 and between the cover cloth 7 and the first splicing part 6.

The upper end edge of the cover cloth 7 is fixed at the upper curtain piece 2 by stitching, and edges at two sides are detachably connected by a buckle, a zipper or a Velcro®.

Curtain Manufacturing Method of a First Embodiment

In this embodiment, the manufacturing method of this curtain is described by taking the above-mentioned Curtain of the second embodiment as an example.

See FIG. 12, the manufacturing method for the curtain shown in FIG. 3 and FIG. 4 includes following steps.

Material preparation step S1, preparing the upper curtain piece 2, the lower curtain piece 3, the fastening cloth 42, and the fastening band 41 that has hooks according to the predetermined size.

Stitching step S2, stitching the fastening cloth 42 at the sun-facing surface of the upper curtain piece, and stitching the fastening band 41 at the backlight surface of the lower curtain piece.

Press gluing step S3, pressing a plurality of laterally arranged adhesive tapes 43 at the predetermined positions on the binding surface of the fastening cloth 42 by press gluing.

Curtain Manufacturing Method of a Second Embodiment Two

In this embodiment, a manufacturing method for the curtain shown in FIG. 3 and FIG. 4 includes following steps.

Material preparation step S1, preparing the upper curtain piece 2, the lower curtain piece 3, the fastening cloth 42, and the fastening band 41 that has hooks according to the predetermined size. A plurality of laterally arranged adhesive tapes are fixed at the binding surface of the fastening cloth 42 in advance, and adhesive tapes are fixed by press gluing or adhesive tapes are adhered at the predetermined positions, thereby omitting the press gluing step S3 in the above-mentioned embodiment.

Stitching step S2, stitching the fastening cloth 42 at the sun-facing surface of the upper curtain piece, and stitching the fastening band 41 at the backlight surface of the lower curtain piece.

In this manufacturing method, the stitching step S2 is a fixing step to for fixing the fastening cloth at the curtain piece in this embodiment. A specific solution of the fixation is not limited to the stitching in the above-mentioned embodiment, and may be fixing solutions such as binding or nailing. The selection of the alignment strip is not limited to the adhesive tape in the above-mentioned embodiment, and may be a thread that has a different color from the fastening band, a button, or a fastening band. The stitching can be done through a heavy thread, and the adhesive tape can not only be fixed by press gluing, but also be fixed by binding, stitching, and so on.

In each above-mentioned embodiment of the curtains, for the number of curtain pieces, a two curtain pieces structure spliced by the upper curtain piece and the lower curtain piece through a lateral flexible splicing assembly is listed, but the selection of the number of curtain pieces is not limited to the above-mentioned embodiments. For example, three curtain pieces or more than four curtain pieces can be used for assembly. At this time, two adjacent curtain pieces constitute a group of upper and lower curtain pieces, and this group of the upper and lower curtain pieces is detachably connected by the lateral flexible splicing assembly, such that a multi curtain pieces structure spliced by more than two lateral flexible splicing assemblies is constituted. One to four groups of the upper and lower curtain pieces structure spliced by two to five curtain pieces are preferred. Further, one group of the upper and lower curtain pieces structure spliced by two curtain pieces or two groups of the upper and lower curtain pieces structure spliced by three curtain pieces is preferred. The detachable splicing structure in the lateral flexible splicing assembly is not limited to the structure in the above-mentioned embodiments. When the zipper, buckle or catch is used as the splicing component, it can be directly fixed at the upper curtain piece and the base cloth is omitted.

In addition, for the alignment strip such as the adhesive tape, it is preferable to adopt a colored strip structure, that is, a not-pure transparent structure, and in the above-mentioned embodiments, the alignment strip with a different color from the fastening cloth is used to improve alignment efficiency. What's more, multi-row structures can be disposed at the lower curtain piece, and the single-row structure can be disposed at the upper curtain piece. For example, for the curtain structure in the first embodiment and the second embodiment, the fastening cloth is fixed at the lower curtain piece, and the fastening band is fixed at the upper curtain piece. For the curtain structure in the fourth embodiment, the one-row buckles are fixed at the upper curtain piece, and the multi-row buckles are fixed at the lower curtain piece. For the curtain structure in the fifth embodiment, the catches are fixed at the upper curtain piece, and the base cloth having lateral cutting openings is fixed at the lower curtain piece.

In this invention, the "lateral flexible splicing assembly" is configured as a connecting assembly structure for detachably connecting the upper curtain piece and the lower curtain piece, and a flexible structure for laterally folding the curtain when the curtain is closed; "a plurality of splicing positions" are configured as more than two splicing positions different in the longitudinal direction of the curtain, preferably configured as more than five splicing positions; and the "planar splicing structure" is configured as a plurality of splicing positions that are consecutively arranged and not discrete.

What is claimed is:

1. A curtain with an adjustable longitudinal size, the curtain comprising:

an upper curtain piece, a lower curtain piece, and a lateral flexible splicing assembly;

wherein the upper curtain piece is a valance, the lower curtain piece is a curtain body, a backlight surface of the lower curtain piece is detachably spliced to a sun-facing surface of the upper curtain piece, and the backlight surface of the lower curtain piece and the sun-facing surface of the upper curtain piece face each other;

wherein the lateral flexible splicing assembly comprises a first splicing part fixed at the sun-facing surface of the upper curtain piece, and a second splicing part fixed at the backlight surface of the lower curtain piece and cooperating with the first splicing part to detachably splice the upper curtain piece and the lower curtain piece;

wherein the first splicing part is provided with a plurality of splicing positions, and the second splicing part detachably connects with a selected one of the splicing positions so as to splice the curtain with different longitudinal sizes;

wherein the lateral flexible splicing assembly further comprises a plurality of laterally-arranged parallel bonding alignment strips covering a portion of the first splicing part, and the second splicing part is not directly connected with the plurality of laterally-arranged parallel bonding alignment strips;

wherein a distance between two adjacent parallel bonding alignment strips is larger than a width of the second splicing part;

wherein the first splicing part is a planar splicing structure and the second splicing part is a fastening band having hooks;

wherein the bonding alignment strips are adhesive tapes, each of the bonding alignment strips is a colored strip structure, and the adhesive tapes are fixed at the first splicing part by press gluing;

wherein a peripheral portion of the first splicing part is fixed at the upper curtain piece by stitching; and a hemline structure for covering a splicing seam is fixed at a lower end portion of the upper curtain piece.

* * * * *